US007231739B2

(12) United States Patent
Scherba

(10) Patent No.: US 7,231,739 B2
(45) **Date of Patent: *Jun. 19, 2007**

(54) INFLATABLE COMPONENT CONNECTOR

(75) Inventor: Robert J. Scherba, Richfield, OH (US)

(73) Assignee: Scherba Industries, Inc., Brunswick, OH (US)

( * ) Notice: Subject to any disclaimer, the term of this patent is extended or adjusted under 35 U.S.C. 154(b) by 219 days.

This patent is subject to a terminal disclaimer.

(21) Appl. No.: 10/921,555

(22) Filed: Aug. 19, 2004

(65) Prior Publication Data

US 2005/0017483 A1 Jan. 27, 2005

Related U.S. Application Data

(63) Continuation of application No. 10/217,677, filed on Aug. 12, 2002, now Pat. No. 6,935,073.

(60) Provisional application No. 60/367,909, filed on Mar. 26, 2002.

(51) Int. Cl.
*E04B 1/00* (2006.01)
*E04C 1/00* (2006.01)

(52) U.S. Cl. ..... 52/2.18; 52/2.11; 52/2.22; 137/223; 137/232; 251/149.1; 251/149.8; 446/224

(58) Field of Classification Search ..... 52/2.11–2.26; 251/149.1, 149.2, 149.4, 149.8; 137/223, 137/844, 845, 847, 885, 232, 523; 446/224; 441/41, 92, 96; 141/115, 392, 285, 287, 141/295, 391

See application file for complete search history.

(56) References Cited

U.S. PATENT DOCUMENTS 3,586,432 A 6/1971 Pentes
3,763,917 A 10/1973 Antinone
3,845,795 A * 11/1974 Andreasson ..... 141/313
3,877,719 A 4/1975 Lewis et al.
3,965,546 A 6/1976 Hickle
4,104,884 A * 8/1978 Preus ..... 405/68
4,361,079 A * 11/1982 Christensen et al. ..... 454/172
4,369,591 A 1/1983 Vicino
4,437,790 A 3/1984 Trop
4,460,674 A 7/1984 Uehara et al.
4,597,633 A 7/1986 Fussell
4,879,030 A * 11/1989 Stache ..... 210/238
5,007,212 A 4/1991 Fritts et al.
RE33,709 E 10/1991 Vicino
5,125,177 A 6/1992 Colting
5,152,092 A 10/1992 O'Brien
5,313,999 A 5/1994 Colson et al.
5,402,591 A 4/1995 Lee (Continued)

OTHER PUBLICATIONS

U.S. Appl. No. 60/367,909, filed Mar. 26, 2002.

(Continued)

*Primary Examiner*—Jeanette Chapman
(74) *Attorney, Agent, or Firm*—Fay Sharpe LLP; Brian E. Turung

(57) ABSTRACT

An inflatable device that includes a inflatable component and a base inflatable component. The inflatable component is releasably connected to the base inflatable component by a component connector. The component connector includes a base and a cap, wherein the cap releasably connected to the base.

40 Claims, 5 Drawing Sheets

U.S. PATENT DOCUMENTS

| | | | |
|---|---|---|---|
| D365,400 | S | 12/1995 | Scherba |
| 5,493,816 | A | 2/1996 | Willemsen |
| 5,555,679 | A | 9/1996 | Scherba |
| 5,570,544 | A | 11/1996 | Hale et al. |
| 5,586,594 | A | 12/1996 | Shapoff |
| 5,921,832 | A | 7/1999 | Thiermann |
| D413,169 | S | 8/1999 | Scherba |
| 5,937,586 | A | 8/1999 | Scherba |
| 6,008,938 | A | 12/1999 | Suehle et al. |
| 6,009,895 | A | 1/2000 | Wass et al. |
| 6,164,314 | A | 12/2000 | Saputo et al. |
| 6,233,767 | B1 | 5/2001 | Horowitz |
| 6,240,666 | B1 | 6/2001 | Apel et al. |
| 6,257,550 | B1 | 7/2001 | Saputo et al. |
| 6,367,934 | B1 | 4/2002 | Salesky et al. |
| 6,581,334 | B2 | 6/2003 | Oney et al. |
| 6,643,875 | B2 | 11/2003 | Boso et al. |
| 6,668,475 | B2 | 12/2003 | Carolan |
| 6,874,263 | B2 | 4/2005 | Ohmuku |

OTHER PUBLICATIONS

U.S. Appl. No. 10/217,677, filed Aug. 12, 2002.

* cited by examiner

INFLATABLE COMPONENT CONNECTOR

The present invention is a continuation of U.S. application Ser. No. 10/217,677 filed Aug. 12, 2002, now U.S. Pat. No. 6,935,073 which in turn claims priority on United States Provisional Patent Application filed 60/367,909 filed Mar. 26, 2002 entitled "INFLATABLE COMPONENT CONNECTOR," which are incorporated herein by reference.

The present invention relates to the art of inflatable devices and, more particularly, to a connector that can releasably connect a removable inflatable component to one or more other components. In particular, the present invention relates to a connector that can releasably connect a removable inflatable component to one or more other inflatable components.

INCORPORATION BY REFERENCE

U.S. Pat. Nos. 5,555,679; 5,937,586; Des. 365,400; and Des. 413,169 illustrate inflatable systems of the type with which this invention can be used, and are incorporated herein by reference.

BACKGROUND OF THE INVENTION

Outdoor sponsored events and activities have gained in popularity over the last several years. During sponsored events and activities such as carnivals, fairs, sporting events, trade shows or the like, various areas are partitioned off to define the area for a particular activity or event. Sporting events sponsored by local and/or national advertisers are very common year-round. These sponsored activities include basketball, volleyball, tennis, hockey, bike racing, skating courses, obstacle courses, skill games, etc. Many of these sponsored activities are one- or two-day events and are commonly situated in a park, a parking lot, a city street, etc. At such events, the event organizer is typically required to assemble temporary facilities for the particular sponsored event or events. Typically, metal or wooden fences are temporarily assembled to partition off various areas for the events. Structures for concession stands, amusement activities, information booths, retail stands, etc. also have to be temporarily assembly for the event. Such structures are also typically wooden and/or metal structures. An event such as outdoor hockey requires a rink to be set up. Such rinks typically include a metal and wood or a foam and vinyl structure which forms the peripheral boundary of the rink. Other types of outdoor events include challenge courses. These challenge courses typically include one or more obstacles for a participant to overcome. Like the rink setup, these challenge courses typically include fenced boundaries and other structures to define the course. Skill games, such as ball pitch games, typically include a metal and wood or a foam and vinyl structure. Such fences, barriers, and other structures require a substantial amount of time and manpower to transport, assemble and disassemble. It is not uncommon for an event organizer to spend several days preparing a site for a single day event. Events which require a large structure to be assembled, such as skating rinks for outdoor hockey and/or challenge courses, require even more time and expense to set up. Although these outdoor sponsored events have become very popular with the public, the complexity and cost of setting up and sponsoring such events has caused many sponsors to limit the number of sponsored events and/or seek other, less expensive and complex activities to sponsor.

Many of these past problems have been addressed in U.S. Pat. Nos. 5,937,586 and Des. 413,169, which are incorporated herein by reference. U.S. Pat. No. 5,937,586 discloses an inflatable device which includes one or more inflatable modules. At least one air portal is positioned in the inflatable module to form a fluid passageway between the interior of the inflatable module and an adjacently positioned inflatable module. Multiple inflatable modules can be connected together to form a variety of structures. Such structures can include, but are not limited to, a skating rink, wall partitions, etc. U.S. Pat. No. 5,937,586 discloses two principal configurations to connect two or more inflatable modules together. In one configuration, two adjacently positioned inflatable modules share a common side wall and a common air portal. The inflatable modules form a sectional unit designed to be inflated and deflated together. In another configuration, two adjacently positioned inflatable modules each have an individual side panel and side air portal. The adjacently positioned side panels of the two inflatable modules are connected together permanently or by a quick connect arrangement to facilitate the connecting and separating of the inflatable modules during assembly and disassembly, respectively. The two adjacently positioned air portals can also be connected together. The air portals between the inflatable modules can be designed to limit the fluid flow between the inflatable modules to at least partially control the pressure in various modules and/or to dampen the pressure fluctuations between various inflatable modules.

Many of the past problems associated with temporary booths or other covered structures have been addressed in U.S. Pat. No. 5,555,679 and Des. 365,400, which are incorporated herein by reference. U.S. Pat. Nos. 5,555,679 and Des. 365,400 disclose an inflatable structure that can function as a portable booth for retail, information, concessions and/or amusement activities at various outdoor sponsored events. This inflatable structure can be conveniently and quickly assembled and disassembled at various outdoor sponsored events without the need to build or assemble metal and/or wood structures at such events.

Although U.S. Pat. Nos. 5,555,679; 5,937,586; Des. 365,400; and Des. 413,169 disclose a significant improvement in assembling portable structures and connecting together various types of inflatable modules, there remains a need for a connection arrangement for inflatable modules that need to be periodically replaced due to wear, and/or for inflatable modules that are interchangeable to meet a particular use of the inflatable system. In certain types of inflatable systems such as, but not limited to, obstacle courses, challenge courses, hockey rinks, etc., certain components are subject to an increased amount of wear, thereby resulting in such components needing to be periodically replaced. For instance, in an inflatable obstacle course, there may include one or more inflatable obstacle structures such as, but not limited to, inflatable tire shaped components for running through, inflatable walls to climb over, inflatable obstacle pillars to run through, and the like. These types of components are subject to significantly increased wear as opposed to the inflatable running surface of the inflatable obstacle course and the boundary walls of the inflatable obstacle course. In past designs for the inflatable obstacle course, these inflatable obstacle structures were sewn to the surface of the inflatable obstacle course. Connection mechanisms such as VELCRO, and zippers were not used, since such connection mechanisms did not retain the inflatable obstacle structures in place, and/or became damaged during use. As a result, when one or more inflatable obstacle structures needed to be replaced, the inflatable obstacle course had be completely deflated and sent to the manufacturer so that the worn or damaged inflatable obstacle structures could be unstitched and removed and new inflatable obstacle structures could be restitched onto the inflatable obstacle course. In addition to the time, cost and inconvenience of having to ship the complete inflatable obstacle course to the manufacturer for repair, the restitching of the new inflatable obstacle structures onto the inflatable obstacle course was both time consuming and complex due to the shapes of the inflatable obstacle structures.

Another problem associated with prior obstacle courses, challenge courses, etc. was that the configuration of the obstacle courses, challenge courses, etc. could not be altered without having to deflate the course and send the course back to the manufacturer for modifications. As a result, the course could not be modified or changed to accommodate various types of events, such as for different age groups, different sexes, different ability levels, etc. In addition, inflatable sponsorship components on the inflatable course could not be easily changed to reflect the different sponsors at different events.

In view of problems and costs associated with replacing inflatable components on an inflatable system and/or modifying the inflatable components on the inflatable system, there is a need for a simple and cost effective connection device which can be used to quickly and cost effectively replace worn inflatable components and/or change out inflatable components on an inflatable system.

SUMMARY OF THE INVENTION

The present invention relates to a removable inflatable component that can be attached to and/or detached from another inflatable component and/or other device, and more particularly to a improved connector that can conveniently releasably connect one removable inflatable component to another inflatable component. The improved connector is particularly applicable to releasably connect removable inflatable components used on obstacle or challenge courses that are subject to high wear and damage during use, and/or that require changing to alter the course for differing activities; however, the present invention has broader applications and can be used to releasably connect a variety of different inflatable components together and/or releasably connect a removable inflatable component to a blower, support structure, or other component. For instance, the improved connector can be used to connect one or more inflatable components together to form a variety of structures such as, but not limited to, inflatable skating rinks, inflatable courts, inflatable wall partitions to section off various areas, inflatable booths and/or bars, inflatable mazes, inflatable rides, inflatable playgrounds, paint ball structures and/or mazes, obstacle courses, skill games, etc.

In accordance with one aspect of the present invention, there is provided a removable inflatable component that is at least partially releasably connected to another inflatable component, blower, and/or other structure by one or more improved connectors. The removable inflatable component can take on a number of different shapes and sizes and is typically formed from one or more panels. In one embodiment of the invention, the sides of the one or more panels are connected together to limit the amount of fluid leakage from the connected panel edges. The one or more panels can be connected in a number of ways such as, but not limited to, a melted seam, glued edges, stitched edges, laced edges, zipped edges, VELCRO connected edges, snapped and/or buttoned edges, tongue and groove connected edges, hooked edges, etc., and/or by any combination of these arrangements. In another and/or alternative embodiment of the invention, the one or more panels are typically made of a flexible material and a durable material. Such materials can include, but are not limited to, Ultra Schercote™ and Ultra Schercote HD™ sold commercially by Scherba, Industries, Inc., coated nylon (e.g. urethane coated nylon), coated Kevlar or Kevlar blends (e.g. urethane coated nylon-Kevlar blend), and/or the like. Such materials are ideally flexible, durable, fluid repellant, and/or substantially fluid impermeable so as to be inflated and deflated without damage or with minimal damage, and/or are durable enough to resist wear and/or exposure to the elements over an extended period of time. As can be appreciated, a wide variety of additional or other materials which are flexible, durable, fluid repellant, and/or substantially non-permeable to various fluids (e.g. liquid, gas, etc.) can used by the present invention. In still another and/or alternative embodiment of the invention, the removable inflatable component includes at least one fluid opening to enable a fluid to flow into and/or out of the removable inflatable component.

In accordance with another and/or alternative aspect of the present invention, the improved connector can be designed in a number of ways, so long as the connector at least partially allows fluid to pass therethrough, and is at least partially releasably connected. In one embodiment, the connector includes a base having an opening that at least partially allows fluid to pass through the opening. In one aspect of this embodiment, the base of the improved connector is connected to a blower or base inflatable component to which the removable inflatable component is to be connected. In another and/or alternative aspect of this embodiment, if the removable inflatable component is to be connected to a blower, the base of the improved connector is formed on and/or connected to the end of the blower. In still another and/or alternative aspect of this embodiment, if the removable inflatable component is to be connected to a base inflatable component, the base of the improved connector is formed on and/or connected to the base inflatable component. In another and/or alternative embodiment of the invention, the base of the improved connector is formed on and/or is connected to the removable inflatable component. In still another and/or alternative embodiment of the invention, the removable inflatable component includes a plurality of fluid openings and one or more openings include one or more bases of the improved connector. In yet another and/or alternative embodiment of the invention, the base of the improved connector can have a variety of shapes and/or sizes, and/or have a variety of opening sizes in the base. In still yet another and/or alternative embodiment of the invention, the base is at least partially formed from a durable material to resist wear. Such materials include, but are not limited to, hard plastic, rubber, fiberglass, metal and/or the like. In a further and/or alternative embodiment of the invention, the base of the improved connector is at least semi-permanently connected to the removable inflatable component, base inflatable component, and/or blower. In one aspect of this embodiment, the base is at least semi-permanently connected by the use of adhesive, stitching, melted seam, rivets, screws, nails, bolts, clamps, locks, and/or the like. In still a further and/or alternative embodiment of the invention, the fluid opening in the base of the improved connector substantially defines the size of the opening for fluid passing into and/or out of the removable inflatable component, base inflatable component, and/or blower when the base is connected to and/or about a fluid opening of a removable inflatable component, base inflatable component, and/or blower. In still yet a further and/or alternative embodiment of the invention, the base includes a connection flange adapted to be connected to the removable inflatable component, base inflatable component, and/or blower. In one aspect of this embodiment, the connection flange fully extends around the perimeter of the base. In another aspect of this embodiment, the connection flange extends partially around the perimeter of the base. In still another and/or alternative aspect of this embodiment, the base includes an extension wall that rises upwardly from the connection flange. In one particular design, the extension wall rises upwardly from the connection flange and terminates at a sealing landing. In yet another and/or alternative aspect of this embodiment, the connection flange contacts the interior surface of the panel of the removable inflatable component and/or base inflatable component when the connection flange is connected to the removable inflatable component and/or base inflatable component. In another and/or alternative aspect of this embodiment, a fluid obstructor to inhibit fluid flow is positioned on and/or about the fluid opening in the base. The fluid obstructor is designed to interfere with the flow of fluid through the opening. Such a fluid obstructor can include, but is not limited to, a valve, a mesh material, filter material, semi-permeable material, and/or the like. The fluid obstructor can be used as a dampener, to assist in ensuring an inflatable module remains inflated, etc.

In accordance with still another and/or alternative aspect of the present invention, the improved connector includes a cap that is designed to at least partially releasably connect to the base of the improved connector. In one embodiment of the invention, the cap is designed to at least partially secure the removable inflatable component to a base inflatable component, and/or blower. In another and/or alternative embodiment of the invention, the cap includes one or more openings to at least partially allow fluid to at least partially pass through the improved connector when the cap is at least partially releasably connected to the base. In yet another and/or alternative embodiment of the invention, the cap includes a connection arrangement to at least partially releasably connect the cap to the base. The connection arrangement can take a number of different arrangements. In one aspect of this embodiment, the connection arrangement includes at least one thread on the cap so that the cap can be at least partially threaded on the base of the improved connector. In another and/or alternative aspect of this embodiment, the connection arrangement includes screws, bolts, latches, pins, and/or the like to releasably secure the cap on the base of the improved connector. As can be appreciated, other and/or additional arrangements can be used to releasably connect the cap to the base of the improved connector. Such arrangements include, but are not limited to, snaps, buttons, zippers, twist locks, latches, clamps, dowels, hooks, key locks, pins, slot connections, tongue and groove connections, non-key locks, connection rings, VELCRO, clamps, roping, cable, etc. The cap can be designed, but is not limited, to at least partially fit about the base, to at least partially fit into the base, to at least partially abut one or more surfaces of the base, etc. In still another and/or alternative embodiment of the invention, the connection arrangement includes a securing flange on the cap and/or base which securing flange is used to releasably connect the base and the cap. In one aspect of this embodiment, the cap includes a securing flange. In another and/or alternative aspect of this embodiment, the base includes a securing flange. In still and/or alternative embodiment of the invention, the securing flange on the base and/or cap includes a connector to releasably secure to the cap or base or securing flange of the cap or base. The connector can include a number of different arrangements such as, but not limited to, snaps, buttons, zippers, twist lock, connection rings, VELCRO, clamps, roping, locks, etc. In yet another and/or alternative embodiment of the invention, the cap includes a sealing flange that extends at least partially about the perimeter of the cap. The sealing flange is adapted to at least partially entrap and/or secure a portion of the panel of the removable inflatable component between the sealing flange and a portion of the base of the improved connector. As such, the sealing flange at least partially secures a portion of the removable inflatable component when the cap is releasably connected to the base. In one aspect of this embodiment, the base of the improved connector includes a sealing landing that extends at least partially about the perimeter of the base. The sealing landing is adapted to at least partially entrap and/or secure a portion of the panel of the removable inflatable component between the sealing flange of the cap and the sealing landing when the cap is releasably connected to the base. In one specific non-limiting design, the connection flange of the base also functions as the sealing landing. In another non-limiting design, the sealing landing is spaced from the connection flange of the base. In this design, the sealing landing can be positioned adjacent to, about, above, or below the connection flange. In still yet another and/or alternative embodiment of the invention, the cap includes a one or more gripping elements to facilitate in the insertion and/or removal of the cap from the base of the improved connector.

In accordance with still yet another and/or alternative aspect of the present invention, the removable inflatable component includes a connection disk. The connection disk can have a variety of shapes and/or sizes. The connection disk includes an opening that is at least partially aligned with and/or is in fluid communication with the fluid opening in the removable inflatable component. In one embodiment of the invention, the connection disk is at least partially designed to reinforce the region of the removable inflatable component and/or inhibit damage to the region of the removable inflatable component that is entrapped and/or secured between the base and the cap when the cap is releasably connected onto the base of the improved connector. In another and/or alternative embodiment of the invention, the connection disk is at least partially designed to inhibit or prevent the region of the removable inflatable component that is entrapped and/or secured between the base and the cap when the cap is releasably connected to the base of the improved connector from disengaging from the cap and/or base. In still another and/or alternative embodiment of the invention, the connection disk is at least partially made of a more rigid and/or resilient material than the material of the removable inflatable component. In yet another and/or alternative embodiment of the invention, the connection disk is partially made of the same or similar material as that of the removable inflatable component. In still yet another and/or alternative embodiment of the invention, the connection disk is secured to the removable inflatable component. The connection disk can be secured to the removable inflatable component in any number of ways such as, but not limited to, a melted seam, adhesive, stitching, lacing, zippers, VELCRO, snaps and/or buttons, tongue and groove connections, hooks, connection rings, clamps, etc., and/or by any combination of these arrangements. In a further and/or alternative embodiment of the invention, the connection disk is at least partially entrapped and/or secured between the base and the cap when the cap is releasably connected to the base of the improved connector.

In accordance with a further and/or alternative aspect of the present invention, the removable inflatable component and/or base inflatable component includes a joining arrangement to at least partially releasably secure the removable inflatable component to a base inflatable component. In one embodiment of the invention, the joining arrangement at least partially secures the removable inflatable component to the base inflatable component at a position at least partially spaced from the improved connector. In one aspect of this embodiment, the joining arrangement is spaced from the improved connector. In another and/or alternative embodiment, the joining arrangement includes one or more arrangements such as, but not limited to, lacing, zippers, ropes, straps, VELCRO, snaps and/or buttons, tongue and groove connections, connection rings, hooks, etc., and/or by any combination of these arrangements. In one aspect of this embodiment, the joining arrangement includes ropes, straps, lacing or the like at least partially connected to the removable inflatable component. The ropes, straps, lacing or the like are adapted to be connected to connectors on the base inflatable component. Such connectors can include, but are not limited to, hooks, grommets, loops, clamps, and/or the like. In one non-limiting design, the hooks, grommets, loops, clamps, and/or the like are connected to a flange, which in turn is connected to the base inflatable component. The flange is typically flexible, but is not required to be. The flange can be made of the same or different material as the base inflatable component. The flange typically is nonreleasably secured to the base inflatable component; however, it can be releasably secured to the base inflatable component. The flange facilitates in the orienting of the hooks, grommets, loops, clamps, and/or the like relative to the removable inflatable component during the connection and disconnection process. In another and/or alternative embodiment of the invention, the joining arrangement includes ropes, straps, lacing or the like at least partially connected to the base inflatable component. The ropes, straps, lacing or the like are adapted to be connected to connectors on the removable inflatable component. Such connectors can include, but are not limited to, hooks, grommets, loops, clamps, and/or the like. In one non-limiting design, the hooks, grommets, loops, clamps, and/or the like are connected to a flange, which in turn is connected to the removable inflatable component. The flange is typically flexible, but is not required to be. The flange can be made of the same or different material as the removable inflatable component. The flange typically is nonreleasably secured to the removable inflatable component; however, it can be releasably secured to the removable inflatable component. The flange facilitates in the orienting of the hooks, grommets, loops, clamps, and/or the like relative to the base inflatable component during the connection and disconnection process. In still another and/or alternative embodiment of the invention, the joining arrangement is the primary arrangement to at least partially releasably secure the removable inflatable component to a base inflatable component. In one aspect of this embodiment, the improved connector also facilitates in securing the removable inflatable component to a base inflatable component. In one non-limiting design, when the joining arrangement is used, the joining arrangement functions as the principal arrangement to at least partially releasably secure the removable inflatable component to the base inflatable component.

In accordance with still a further and/or alternative aspect of the present invention, the removable inflatable component includes at least one access opening to enable an individual to insert the cap onto and/or remove the cap from the base of the improved connector during the connecting and/or disconnecting of the removable inflatable component onto or from the base inflatable component and/or blower. In one embodiment, the access opening is located in at least one panel of the removable inflatable component and adjacent to the fluid opening of the removable inflatable component. In one aspect of this embodiment, during the insertion of the removable inflatable component onto the base inflatable component and/or blower, the fluid opening in the removable inflatable component is inserted at least partially about the extension wall of the base of the improved connector. The individual installing the removable inflatable component onto the base component can place his/her hand through the access opening and guide the fluid opening in the removable inflatable component at least partially about the extension wall of the base of the improved connector. Once the fluid opening is inserted about the extension wall of the base, the individual can then place his/her hand through the access opening and releasably secure the cap onto the base of the improved connector. In another and/or alternative embodiment, the access opening is at least partially closable to at least partially inhibit fluid from passing through the access opening. In one aspect of this embodiment, the access opening is at least partially closed by, but not limited to, zippers, VELCRO, buttons, snaps, hooks and/or the like. In still another and/or alternative embodiment, the removable inflatable component is connected to the base inflatable component via the securing arrangement before or after the access opening is used to releasably secure the cap to the base. When the removable inflatable component needs to be replaced and/or removed from the base inflatable component, the above described sequence of steps is reversed.

In accordance with still yet a further and/or alternative aspect of the present invention, the connection arrangement includes a securing mechanism to inhibit or prevent the base and cap from inadvertently releasably disconnecting from one another. Such securing arrangement can includes a variety of arrangements such as, but not limited to, bolts, screws, pins, clips, snaps, connection rings, hooks, latches, roping, etc. and the like.

In accordance with still yet a further and/or alternative aspect of the present invention, the removable inflatable component can be used by itself or in combination with one or more base inflatable components to form a wail, a boundary, a rink, an enclosure, an obstacle or challenge coarse, a playground, etc. In one embodiment of the invention, the sides of the removable inflatable component and the one or more base inflatable components are aligned so that the fluid opening between the removable inflatable component and the one or more base inflatable components are at least partially aligned, thereby providing a passageway for the fluid between the interiors of the removable inflatable component and the one or more base inflatable components. In another and/or alternative embodiment, the fluid opening in the removable inflatable component and/or the one or more base inflatable components is smaller than the surface area of the panel the fluid opening is inserted therein, so as to create a pressure drop when the fluid passes through the fluid opening. This type of fluid opening design facilitates in maintaining the removable inflatable component and the one or more base inflatable components in a substantially fully inflated state. Furthermore, the removable inflatable component and the one or more base inflatable components resist deflating when one of the sides of the removable inflatable component and the one or more base inflatable components are impacted. This damping action of pressure differentials between the removable inflatable component and the one or more base inflatable components helps to stabilize and maintain the integrity of the inflatable structure. In still another and/or alternative embodiment, the fluid opening in the removable inflatable component is positioned substantially in the center of the panel containing the fluid opening to provide a substantially uniform fluid flow and/or fluid pressure into and/or out of the removable inflatable component; however, the fluid opening can be positioned in other locations on the panel. In yet another and/or alternative embodiment, a semi-permeable boundary can be positioned at least partially about the fluid opening to limit the fluid flow through the semi-permeable boundary. In one aspect of this embodiment, the semi-permeable boundary includes, but is not limited to, a mesh material, semi-fluid permeable material, and/or the like. In one non-limiting arrangement, the mesh material is similar to or the same as disclosed in U.S. Pat. No. 5,937,586, which is incorporated herein by reference.

In accordance with another and/or alternative aspect of the present invention, two or more base inflatable components are connected together to form a larger inflatable structure. In one embodiment, the arrangements to connect the two or more base inflatable components can be similar to or the same as the arrangements disclosed in U.S. Pat. No. 5,937,586, which is incorporated herein by reference.

In accordance with yet another and/or alternative aspect of the present invention, the removable inflatable component and/or one or more base inflatable components can be formed by multiple panels. In one embodiment, the manner in which the removable inflatable component and/or one or more base inflatable components are formed is similar to or the same as the manner disclosed in U.S. Pat. No. 5,937,586, which is incorporated herein by reference.

In accordance with still another and/or alternative aspect of the present invention, the removable inflatable component and/or one or more base inflatable components include an air vacating arrangement which provides for quick deflation of the removable inflatable component and/or one or more base inflatable components when the removable inflatable component and/or one or more base inflatable components are being disassembled. The air vacating mechanism can also be designed to allow access to the interior of the removable inflatable component and/or one or more base inflatable components for purposes of repair, assembly, disassembly, insertion of weights, etc. In one embodiment, the design and/or arrangement of the air vacating arrangement is similar to or the same as the manner disclosed in U.S. Pat. No. 5,937,586, which is incorporated herein by reference.

In accordance with still yet another and/or alternative aspect of the present invention, the removable inflatable component and/or one or more base inflatable components include a support structure to support at least a portion of the removable inflatable component and/or one or more base inflatable components. In one embodiment of the invention, the support structure includes a pole support to at least partially support and/or secure a pole to the removable inflatable component and/or one or more base inflatable components. In one aspect of this embodiment, the design and/or arrangement of the pole support is similar to or the same as the manner disclosed in U.S. Pat. No. 5,937,586, which is incorporated herein by reference.

In accordance with a further and/or alternative aspect of the present invention, the improved connector includes one or more fluid seals to reduce the amount of fluid escaping from the connector. In one embodiment, at least one seal is positioned between the cap and the base of the connector to reduce the amount of fluid escaping between the cap and the base. In one aspect of this embodiment, at least one seal is connected to the base. In another and/or alternative aspect of this embodiment, at least one seal is connected to the cap. In still another and/or alternative aspect of this embodiment, at least one seal is not connected to the base or the cap. In another and/or alternative embodiment, at least one seal is made of a flexible, resilient and durable material. In one aspect of this embodiment, the seal is at least partially made of rubber, plastic, and/or the like.

The primary object of the present invention is to provide an inflatable device that includes one or more removable inflatable components that can be releasably connected to one or more base inflatable components, blowers, and/or other components.

Another and/or alternative object of the present invention is to provide an inflatable device that can have one or more removable inflatable components repaired or replaced without having to return the complete inflatable device to the manufacturer.

Yet another and/or alternative object of the present invention is to provide an improved connector that can releasably connect the fluid opening of a removable inflatable component to one or more base inflatable components and/or blowers.

Still another and/or alternative object of the present invention is to provide an improved connector having a base and a cap that is releasably connected to the base.

Still yet another and/or alternative object of the present invention is to provide an improved connector wherein the base of the connector is secured to a portion of the removable inflatable component or base inflatable component.

A further and/or alternative object of the present invention is to provide an improved connector that allows fluid flow through a fluid opening.

Still a further and/or alternative object of the present invention is to provide an improved connector that includes a fluid obstructor.

Yet a further and/or alternative object of the present invention is to provide an improved connector wherein the base includes a connection flange.

Still yet a further and/or alternative object of the present invention is to provide an improved connector wherein the base includes sealing landing.

Another and/or alternative object of the present invention is to provide an improved connector wherein the cap includes a sealing flange.

Still another and/or alternative object of the present invention is to provide an improved connector wherein the cap includes gripping elements.

Yet another and/or alternative object of the present invention is to provide an inflatable device that includes one or more removable inflatable components or base inflatable components that include a connection disk.

Still yet another and/or alternative aspect of the present invention is to provide an improved connector having a sealing element positioned between the cap and the base.

A further and/or alternative object of the present invention is to provide an inflatable device that includes one or more removable inflatable components or base inflatable components having a securing arrangement and an improved connector to at least partially secure one or more removable inflatable components to one or more base inflatable components.

Still a further and/or alternative object of the present invention is to provide an inflatable device that includes one or more removable inflatable components or base inflatable components having an access opening.

Yet a further and/or alternative object of the present invention is to provide an inflatable device that can be formed into inflatable skating rinks, inflatable courts, inflatable wall partitions to section off various areas, inflatable booths and/or bars, inflatable mazes, inflatable rides, inflatable playgrounds, paint ball structures and/or mazes, obstacle courses, etc.

These and other objects and advantages will become apparent to those skilled in the art upon reading and following the description taken together with the accompanying drawings.

BRIEF DESCRIPTION OF THE DRAWINGS

Reference may now be made to the drawings which illustrate various preferred embodiments that the invention may take in physical form and in certain parts and arrangement of parts wherein.

DETAILED DESCRIPTION OF THE PREFERRED EMBODIMENT

Figure 1:
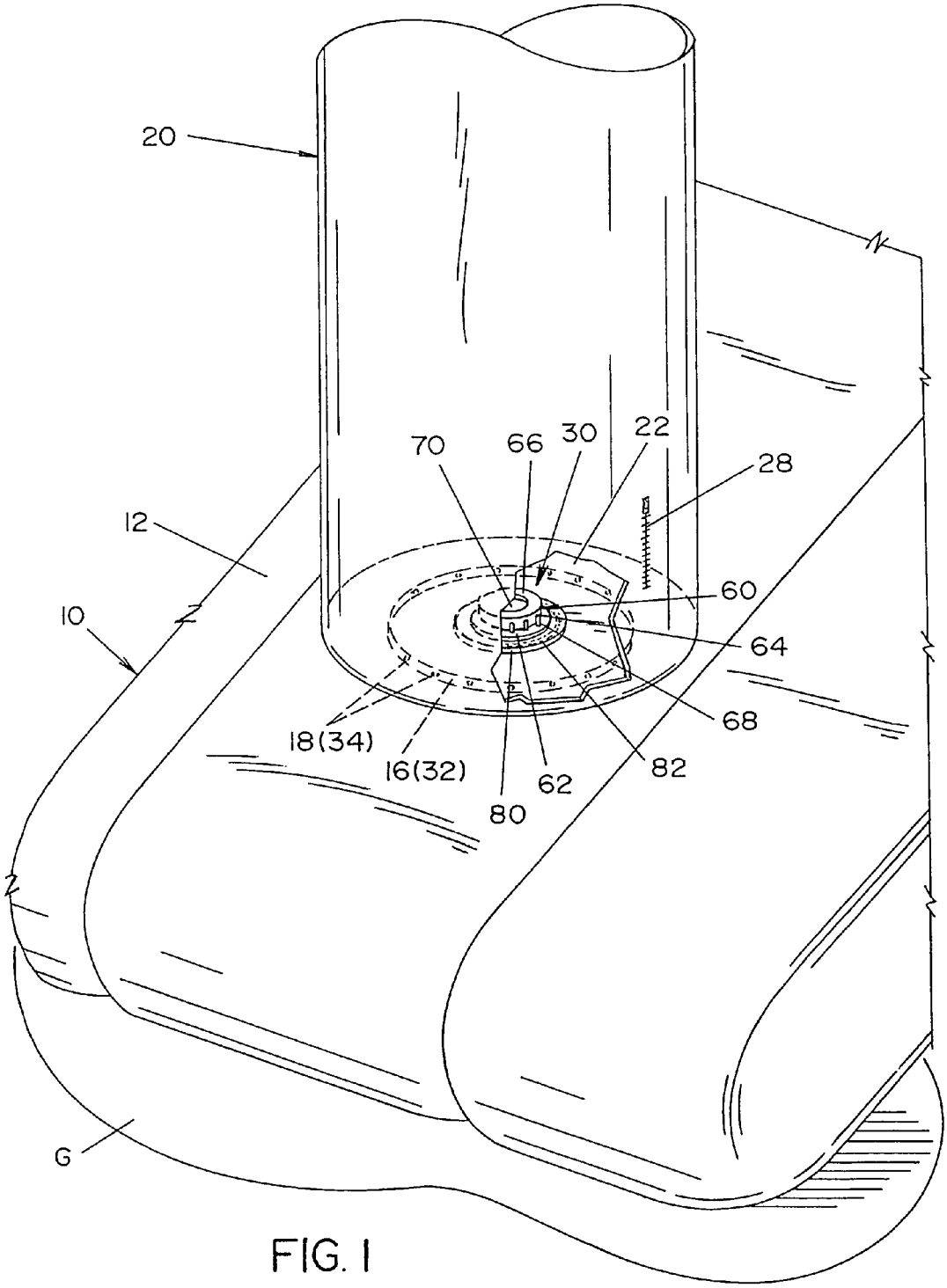
FIG. 1 is a partial elevation view of a base inflatable component connected a base inflatable component by the improved connector of the present invention.
Figure 2:
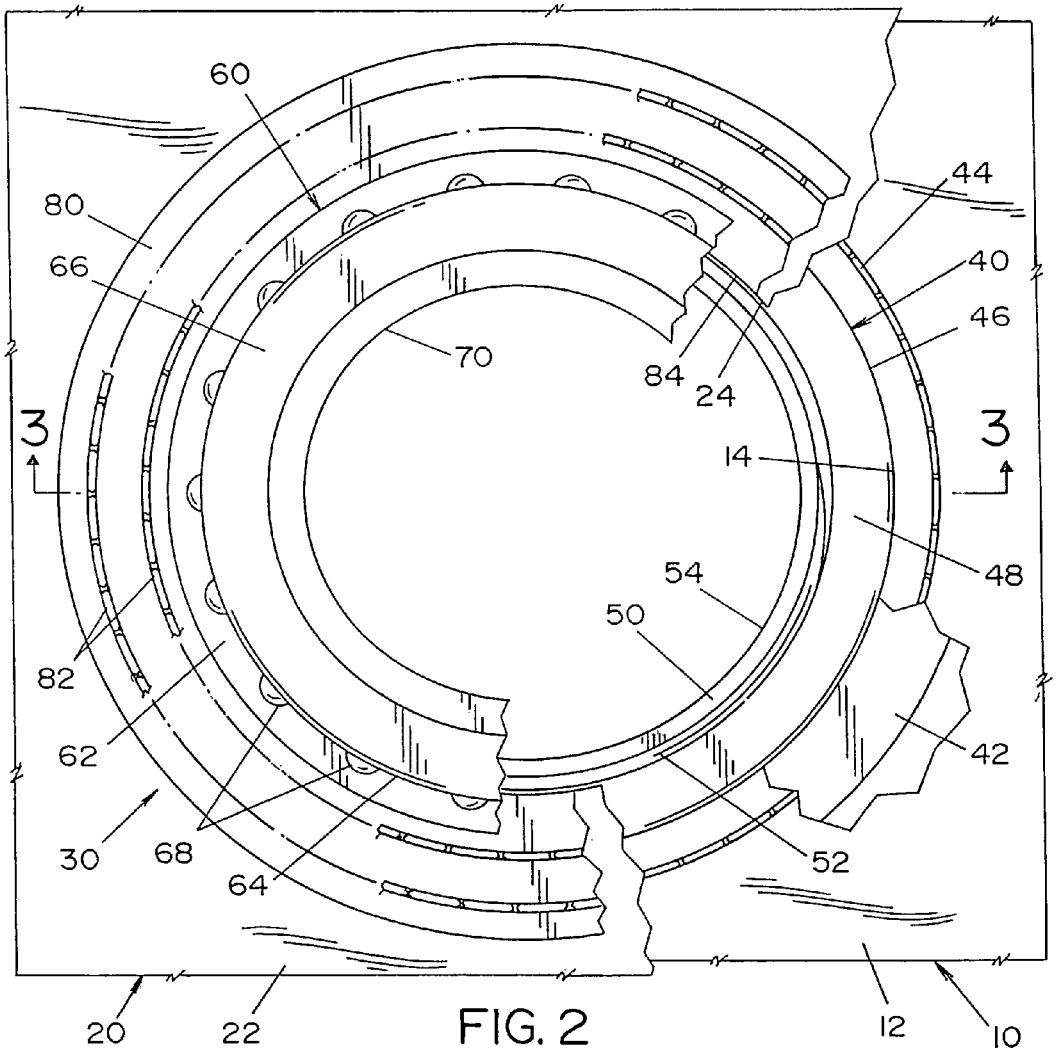
FIG. 2 is a top view of the improved connector of FIG. 1.

Referring now to the drawings wherein the showings are for the purpose of illustrating a preferred embodiment of the invention only and not for the purpose of limiting same, FIG. 1 discloses a portion of a base inflatable component 10 laying on a ground surface G and having a removable inflatable structure 20 connected to a top surface 12 of the base inflatable structure. The base inflatable structure is illustrated as being a portion of a larger inflatable bottom structure that can be used as a playing surface for some sporting activity. For example, the base inflatable structure can form the playing surface of an obstacle or challenge coarse. The bottom portion of the removable inflatable structure is illustrated as being substantially cylindrical and can be a portion of an obstacle that is connected to the base inflatable structure. As can be appreciated, the base inflatable structure and/or the removable inflatable structure can be used for unlimited other purposes. In addition, the base inflatable structure and/or the removable inflatable structure can have a variety of shapes and sizes. Typically, the base inflatable structure is larger than the removable inflatable structure; however, this is not required. The base inflatable structure and the removable inflatable structure are typically made of a flexible, durable material. The materials used to form the base inflatable structure and the removable inflatable structure can be the same or different.

Figure 3:
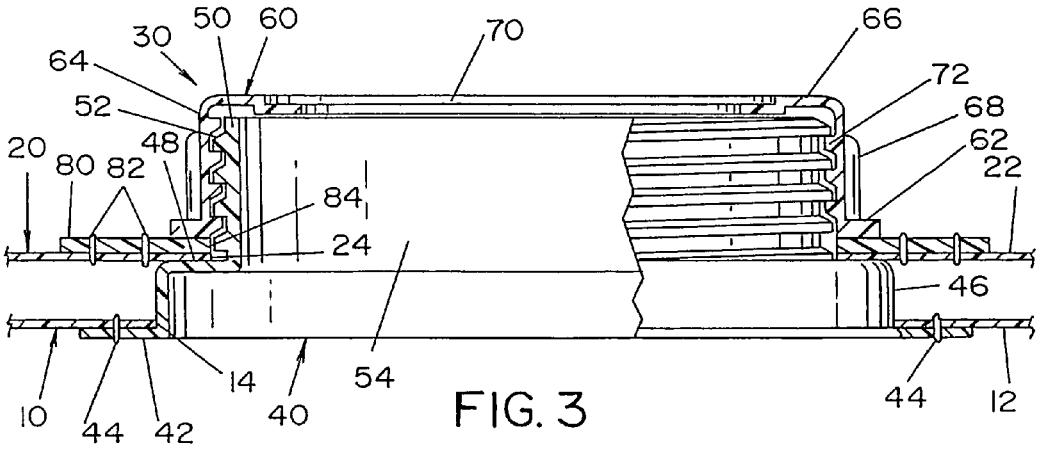
FIG. 3 is a cross-sectional view along line 3-3 of FIG. 2.
Figure 6:
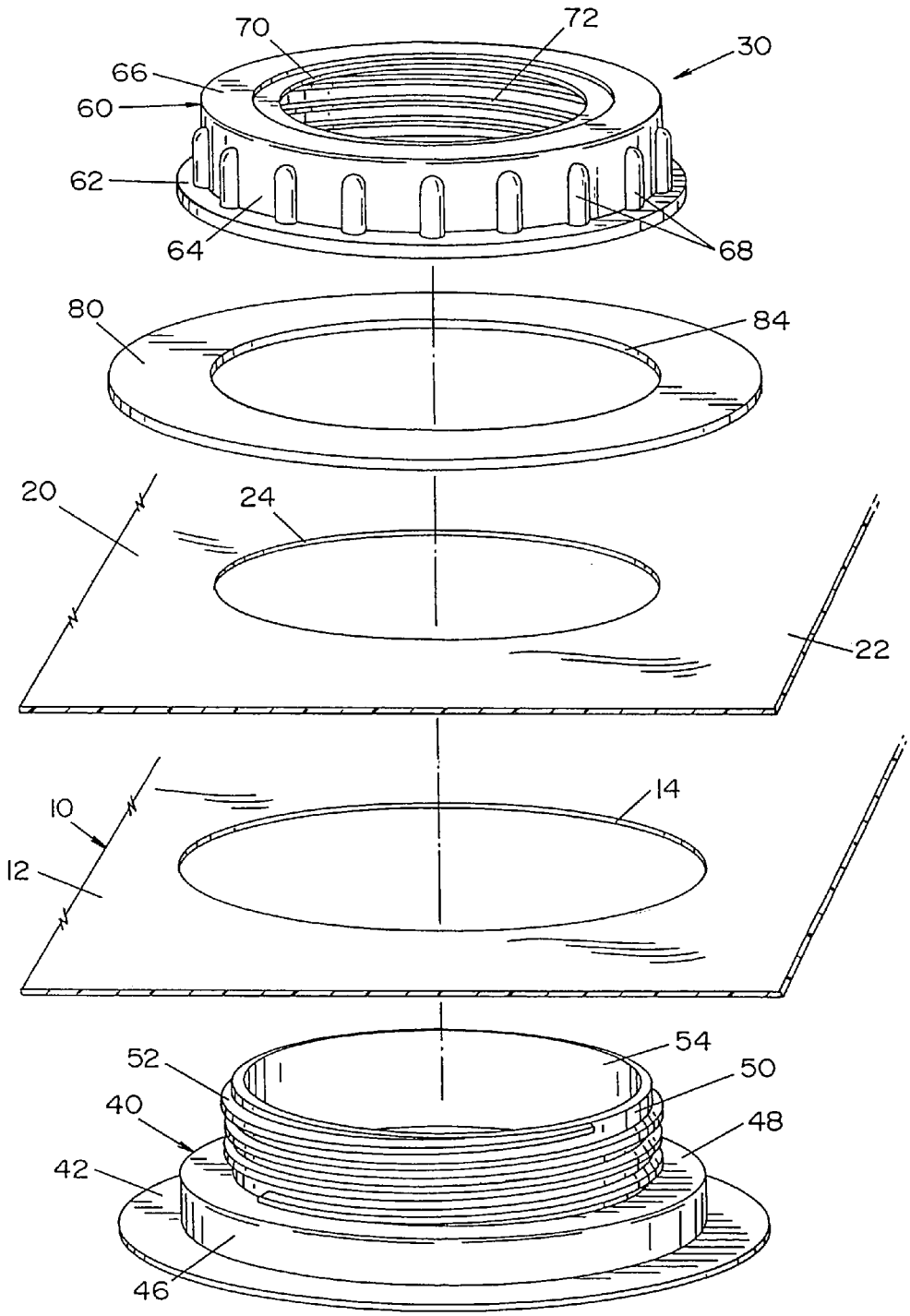

Referring again to FIG. 1, a component connector 30 is illustrated as detachably connecting the removable inflatable structure to the base inflatable structure. The component connector includes a base 40 and a cap 60. The structure of the base and the cap are best illustrated in FIG. 6. Base 40 includes a connection flange 42 that is used to connect the base to the base inflatable structure. As illustrated in FIG. 3, the connection flange is connected to the base inflatable structure by stitching 44; however, other and/or additional mechanisms can be used to connect the base inflatable structure to the connection flange such as, but not limited to, adhesives, staples, rivets, melted seams, soldering, welding, etc. Spaced inwardly from the peripheral edge of the connection flange and rising upwardly from the top surface of the connection flange is an extension wall 46. Extension wall 46 terminates at sealing landing 48. As illustrated in FIGS. 3 and 6, a portion of the base inflatable section 10 includes an opening 14 in the top surface. Opening 14 is sized and shaped to fit closely around extension wall 46 and to rest at least partially on the top surface of connection flange 42. The cross-sectional shape of extension wall 46 is shown to be substantially cylindrical; however, other shapes can be used. Once opening 14 is fitted about the extension wall, stitching 44 is used to connect the base inflatable section to connection flange 42. The base is illustrated as being stitched to a portion of the base inflatable component by nylon thread; however, other materials for the stitching can be used such as, but not limited to, polyester, Kevlar, nylon blends, polyester blends, Kevlar blends, and/or the like. One row of stitching is illustrated; however, more rows of stitching can be used to connect the base to the base inflatable component.

Referring again to FIG. 6, a threaded wall 50 including threads 52 is spaced inwardly from the outer peripheral edge of the sealing landing and rises upwardly from the top surface of the sealing landing. Threaded wall 50 includes an opening 54 that passes through base 40.

Now referring to FIGS. 3 and 6, cap 60 includes a sealing flange 62 that is designed to at least partially entrap a portion of removable inflatable structure 20 between the sealing flange and sealing landing 48 of base 40. Spaced inwardly from the outer peripheral edge of the sealing flange is a side wall 64 that extends upwardly from the top surface of the sealing flange and terminates at the top surface 66 of cap 60. Positioned on side wall 64 are a plurality of grip ribs 68. The grip ribs facilitate in the gripping of the cap during the insertion onto and/or removal of the cap from base 40. An opening 70 is positioned in top surface 66 of the cap and extends through the cap. A threaded surface 72 is formed on the interior surface of side wall 64. The size of opening 70 and the orientations of threaded surface 72 are designed such that the cap can be threaded onto threads 52 of threaded wall 50 of base 40 as illustrated in FIG. 3.

Referring again to FIGS. 3 and 6, a connection disk 80 is secured by stitching 82 about opening 24 in a bottom section 22 of the removable inflatable structure. As can be appreciated, the connection disk can be connected to the removable inflatable structure of other and/or additional mechanisms such as, but not limited to, adhesives, staples, rivets, melted seams, soldering, welding, etc. The connection disk is illustrated as being stitched to a portion of the removable inflatable component by a nylon thread; however, other materials for the stitching can be used such as, but not limited to, polyester, Kevlar, nylon blends, polyester blends, Kevlar blends, and/or the like. Two rows of stitching are illustrated; however, more or less rows of stitching can be used to connect the connection disk to the removable inflatable component. Connection disk 80 includes an opening 84 that is sized and shaped to be inserted about threaded wall 50 of base 40 without fitting about sealing landing 48 as illustrated in FIG. 3. Connection disk 80 is typically made of a more durable and rigid material than removable inflatable structure 20; however, this is not required. Connection disk 80 is primarily designed to resist undue wear and/or damage to the removable inflatable component around the region of opening 24 which can be caused by the repeated insertion and/or removal of cap 60 from base 40.

Figure 4:
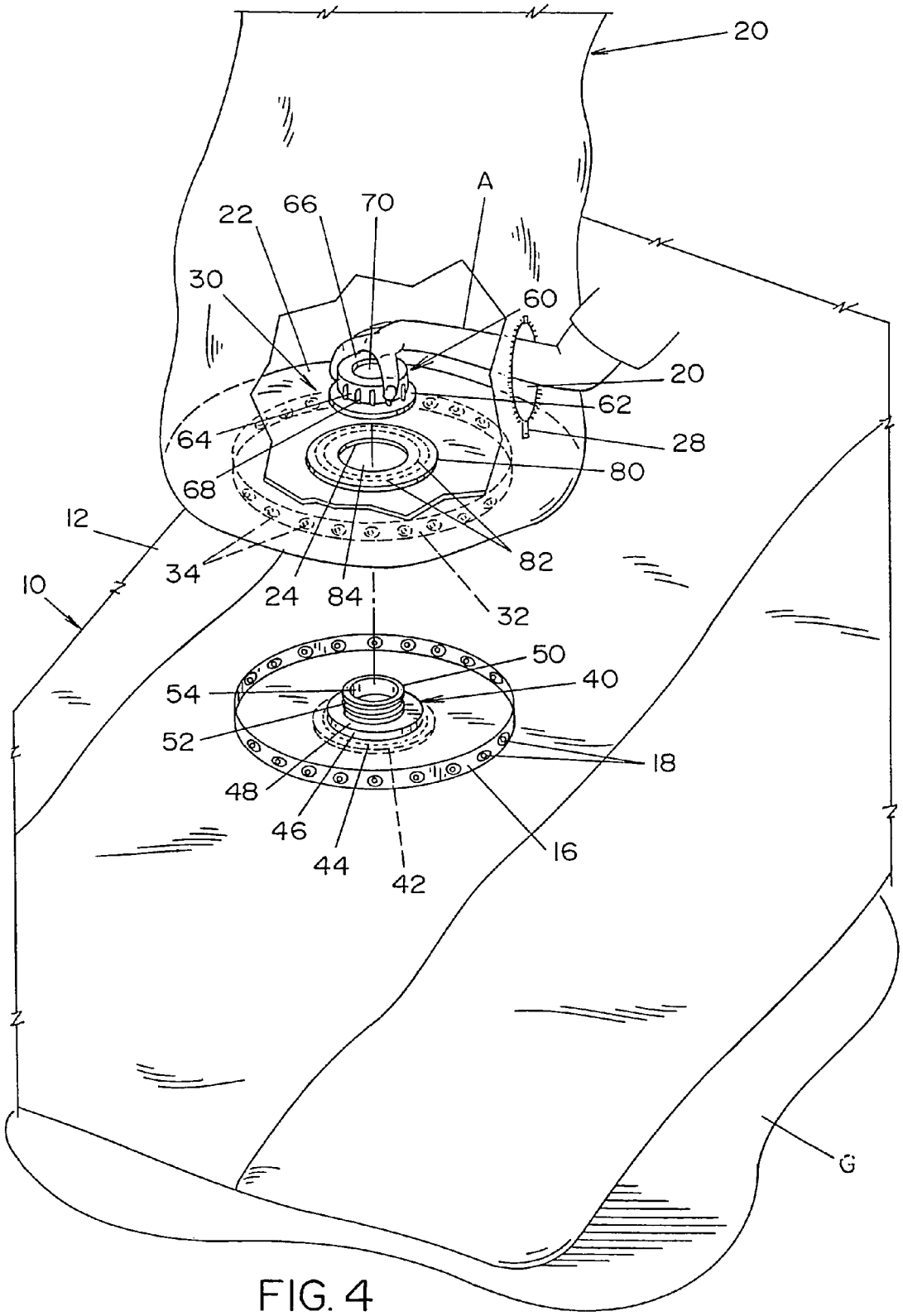
FIG. 4 is a partial elevation view of a base inflatable component disconnected from the base inflatable component by removing the cap of the improved connector from the base of the improved connector.
Figure 5:
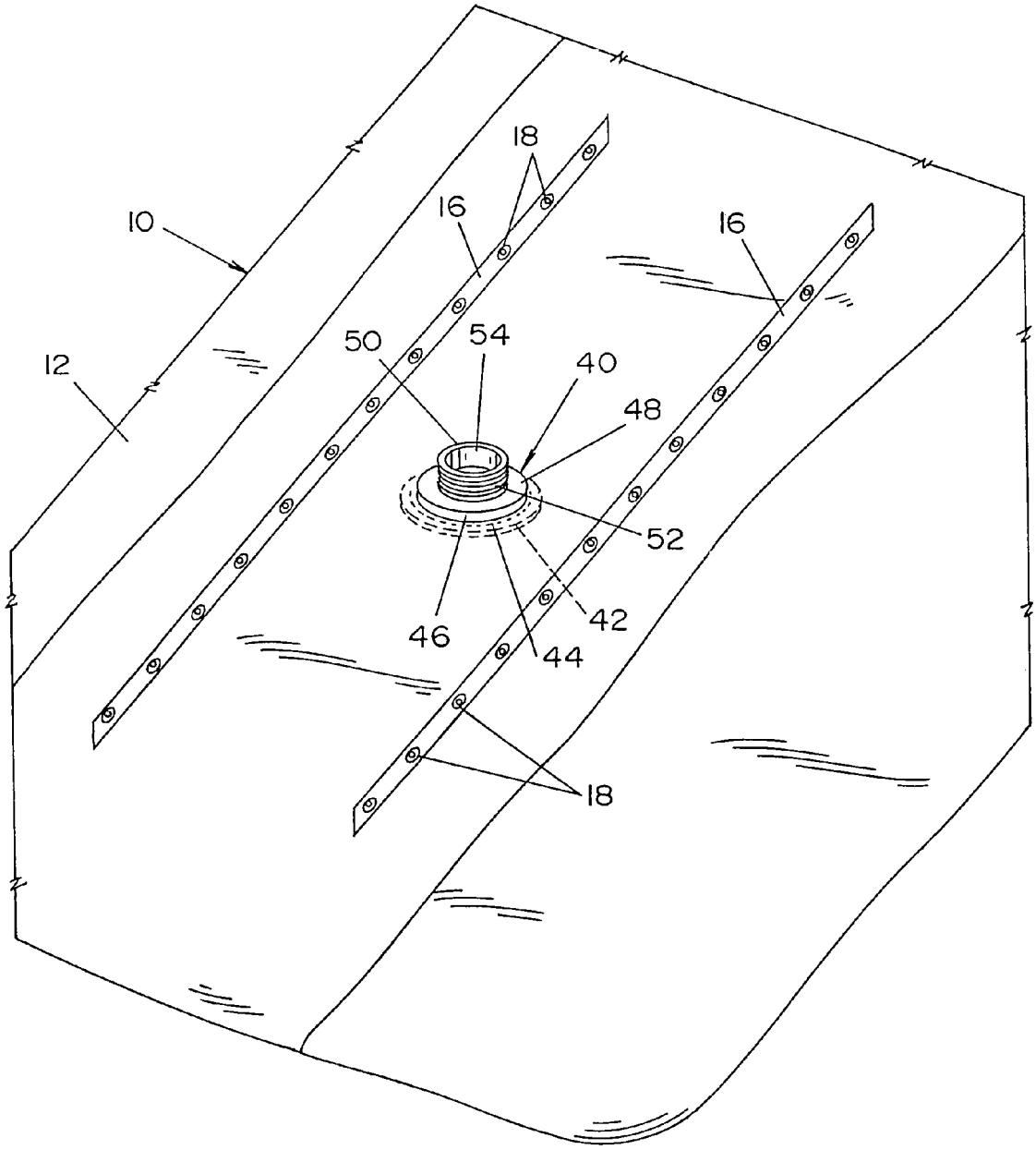
FIG. 5 is a partial elevation view of another base inflatable component; and, FIG. 6 is an exploded elevation view of the connector of the present invention.

Referring now to FIGS. 4 and 5, the base inflatable structure includes one or more flexible flanges 16 connected to top surface 12. The flexible flange includes a plurality of openings 18. The flexible flange is typically stitched to the base inflatable structure; however, other and/or additional mechanisms can be used such as, but not limited to, adhesives, staples, rivets, melted seams, soldering, welding, etc. FIG. 4 illustrates a single circular flexible flange, whereas FIG. 5 illustrates two linear flexible flanges. In both FIGS. 4 and 5, the flexible flanges are designed to connect the removable inflatable structure to the base inflatable structure at a location that is spaced from opening 24 in the removable inflatable structure and opening 14 of the base inflatable structure. The different configurations of the flexible flanges are to accommodate different shaped removable inflatable components. As illustrated in FIG. 4, bottom section 22 of removable inflatable structure 20 is substantially circular. As a result, flexible flange 16 is shaped to also be substantially circular. The two substantially linear flexible flanges 16 shown in FIG. 5 are designed to be connected to a rectangular shaped bottom section of a removable inflatable structure. As can be appreciated, other configurations of the flexible flange on the base inflatable structure can be used to accommodate other shaped bottom sections of a removable inflatable structure. The flexible flange can be made of the same or similar material as the base inflatable structure.

The use of component connector will now be described. Referring now to FIG. 4, base inflatable structure 10 and removable inflatable structure 20 are in a deflated state. Removable inflatable structure 20 is connected to the base inflatable structure by first positioning the removable inflatable structure near an opening 14 in the base inflatable structure, which opening includes a base 40. After removable inflatable structure 20 is properly positioned, the assembler opens a side opening 26 in the removable inflatable structure. The side opening is shown to be opened and closed by a zipper 28. As can be appreciated, side opening 26 can be opened and closed by other and/or additional mechanisms. The opening and closing mechanism is typically designed to allow relatively easy access to the interior of the removable inflatable structure and to substantially inhibit or prevent fluid such as, but not limited to, air from entering into and/or escaping from the side opening when the side opening is closed.

After side opening 26 is opened, the assembler inserts his/her arm A into the side opening, and positions opening 24 of removable inflatable structure 20 and opening 84 of connection disk 80 over and about threaded wall 50 of base 40 until bottom section 22 rests on sealing landing 48. Cap 60 is then inserted on base 40 and threaded onto threaded wall 50 until a portion of bottom section 22 and a portion of connection disk 80 is entrapped between sealing landing 48 and sealing flange 62. The openings in the base and cap allow fluid to flow between opening 14 in base inflatable structure 10 and opening 24 in removable inflatable structure 20. Once the cap is secured on the base of the component connector, the assembler removes his/her arm from the side opening and the side opening is then closed. Removable inflatable structure 20 is then further secured to the bases inflatable structure by connecting the flexible flange 16 on the base inflatable structure to the flexible flange 32 on the removable inflatable structure. Typically, roping is threaded through openings 18 in flexible flange 16 and openings 34 in flexible flange 32 so as to secure the removable inflatable structure to the base inflatable structure. Typically, the openings are reinforced by plastic or metal grommets. As can be appreciated, other or additional mechanisms can be used to secure the removable inflatable structure to the base inflatable structure. The connection formed between the flexible flanges facilitates in protecting the fluid connection between the removable inflatable structure and the base inflatable structure from damage. After the removable inflatable structure and the base inflatable structure have been connected together, the removable inflatable structure and the base inflatable structure are inflated as illustrated in FIG. 1. To disconnect removable inflatable structure 20, the above steps are reversed.

The invention has been described with reference to the preferred embodiment and alternatives thereof. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

I claim:

1. An inflatable device comprising a removable inflatable component and a base inflatable component, said removable inflatable component and said base inflatable component each having an internal cavity and designed to be inflated and deflated by a fluid, said removable inflatable component at least partially releasably connected to said base inflatable component by a component connector, said component connector including a base and a cap, said cap releasably connected to said base by a connection arrangement, said component connector allowing fluid to flow through said component connecter and into the internal cavity of said removable inflatable component and said base inflatable component when said cap is connected to said base and said component connector at least partially connects said removable component to said base component.

2. The inflatable device as defined in claim 1, wherein at least a portion of said cap is inserted about at least a portion of said base.

3. The inflatable device as defined in claim 1, wherein said connection arrangement includes a thread on said cap.

4. The inflatable device as defined in claim 2, wherein said connection arrangement includes a thread on said cap.

5. The inflatable device as defined in claim 1, wherein said connection arrangement includes a securing arrangement to at least inhibit the inadvertent disconnection of said cap from said base.

6. The inflatable device as defined in claim 2, wherein said connection arrangement includes a securing arrangement to at least inhibit the inadvertent disconnection of said cap from said base.

7. The inflatable device as defined in claim 1, wherein said at least a portion of said removable inflatable component is entrapped between said base and said cap of said component connector when said component connector at least partially releasably connects said removable inflatable component to said base inflatable component.

8. The inflatable device as defined in claim 2, wherein said at least a portion of said removable inflatable component is entrapped between said base and said cap of said component connector when said component connector at least partially releasably connects said removable inflatable component to said base inflatable component.

9. The inflatable device as defined in claim 4, wherein said at least a portion of said removable inflatable component is entrapped between said base and said cap of said component connector when said component connector at least partially releasably connects said removable inflatable component to said base inflatable component.

10. The inflatable device as defined in claim 5, wherein said at least a portion of said removable inflatable component is entrapped between said base and said cap of said component connector when said component connector at least partially releasably connects said removable inflatable component to said base inflatable component.

11. The inflatable device as defined in claim 3, wherein said at least a portion of said removable inflatable component is entrapped between said base and said cap of said component connector when said component connector at least partially releasably connects said removable inflatable component to said base inflatable component.

12. The inflatable device as defined in claim 1, wherein said removable inflatable component includes a connection disk that is at least partially secured to said removable inflatable component and about a fluid passageway in said removable inflatable component, said connection disk formed of a material to inhibit damage to said removable inflatable component about said fluid passageway when said cap is connected to said base.

13. The inflatable device as defined in claim 2, wherein said removable inflatable component includes a connection disk that is at least partially secured to said removable inflatable component and about a fluid passageway in said removable inflatable component, said connection disk formed of a material to inhibit damage to said removable inflatable component about said fluid passageway when said cap is connected to said base.

14. The inflatable device as defined in claim 7, wherein said removable inflatable component includes a connection disk that is at least partially secured to said removable inflatable component and about a fluid passageway in said removable inflatable component, said connection disk formed of a material to inhibit damage to said removable inflatable component about said fluid passageway when said cap is connected to said base.

15. The inflatable device as defined in claim 9, wherein said removable inflatable component includes a connection disk that is at least partially secured to said removable inflatable component and about a fluid passageway in said removable inflatable component, said connection disk formed of a material to inhibit damage to said removable inflatable component about said fluid passageway when said cap is connected to said base.

16. The inflatable device as defined in claim 10, wherein said removable inflatable component includes a connection disk that is at least partially secured to said removable inflatable component and about a fluid passageway in said removable inflatable component, said connection disk formed of a material to inhibit damage to said removable inflatable component about said fluid passageway when said cap is connected to said base.

17. The inflatable device as defined in claim 11, wherein said removable inflatable component includes a connection disk that is at least partially secured to said removable inflatable component and about a fluid passageway in said removable inflatable component, said connection disk formed of a material to inhibit damage to said removable inflatable component about said fluid passageway when said cap is connected to said base.

18. The inflatable device as defined in claim 12, wherein at least a portion of said connection disk and at least a portion of said removable inflatable component is entrapped between said base and said cap of said component connector when said component connector at least partially releasably connects said removable inflatable component to said base inflatable component.

19. The inflatable device as defined in claim 13, wherein at least a portion of said connection disk and at least a portion of said removable inflatable component is entrapped between said base and said cap of said component connector when said component connector at least partially releasably connects the removable inflatable component to the base inflatable component.

20. The inflatable device as defined in claim 14, wherein at least a portion of said connection disk and at least a portion of said removable inflatable component is entrapped between said base and said cap of said component connector when said component connector at least partially releasably connects said removable inflatable component to said base inflatable component.

21. The inflatable device as defined in claim 15, wherein at least a portion of said connection disk and at least a portion of said removable inflatable component is entrapped between said base and said cap of said component connector when said component connector at least partially releasably connects said removable inflatable component to said base inflatable component.

22. The inflatable device as defined in claim 16, wherein at least a portion of said connection disk and at least a portion of said removable inflatable component is entrapped between said base and said cap of said component connector when said component connector at least partially releasably connects said removable inflatable component to said base inflatable component.

23. The inflatable device as defined in claim 17, wherein at least a portion of said connection disk and at least a portion of said removable inflatable component is entrapped between said base and said cap of said component connector when said component connector at least partially releasably connects said removable inflatable component to said base inflatable component.

24. The inflatable device as defined in claim 1, wherein said base of said component connector includes a connection flange and a sealing landing, at least a portion of said base inflatable component connected to said connection flange, said sealing landing spaced from said connection flange.

25. The inflatable device as defined in claim 2, wherein said base of said component connector includes a connection flange and a sealing landing, at least a portion of said base inflatable component connected to said connection flange, said sealing landing spaced from said connection flange.

26. The inflatable device as defined in claim 18, wherein said base of said component connector includes a connection flange and a sealing landing, at least a portion of said base inflatable component connected to said connection flange, said sealing landing spaced from said connection flange.

27. The inflatable device as defined in claim 19, wherein said base of said component connector includes a connection flange and a sealing landing, at least a portion of said base inflatable component connected to said connection flange, said sealing landing spaced from said connection flange.

28. The inflatable device as defined in claim 21, wherein said base of said component connector includes a connection flange and a sealing landing, at least a portion of said base inflatable component connected to said connection flange, said sealing landing spaced from said connection flange.

29. The inflatable device as defined in claim 1, wherein said removable inflatable component and said base inflatable component include a joining arrangement at least partially positioned about and spaced from said component connector, said joining arrangement designed to at least partially releasably connect said removable inflatable component to said base inflatable component.

30. The inflatable device as defined in claim 2, wherein said removable inflatable component and said base inflatable component include a joining arrangement at least partially positioned about and spaced from said component connector, said joining arrangement designed to at least partially releasably connect said removable inflatable component to said base inflatable component.

31. The inflatable device as defined in claim 24, wherein said removable inflatable component and said base inflatable component include a joining arrangement at least partially positioned about and spaced from said component connector, said joining arrangement designed to at least partially releasably connect said removable inflatable component to said base inflatable component.

32. The inflatable device as defined in claim 27, wherein said removable inflatable component and said base inflatable component include a joining arrangement at least partially positioned about and spaced from said component connector, said joining arrangement designed to at least partially releasably connect said removable inflatable component to said base inflatable component.

33. The inflatable device as defined in claim 28, wherein said removable inflatable component and said base inflatable component include a joining arrangement at least partially positioned about and spaced from said component connector, said joining arrangement designed to at least partially releasably connect said removable inflatable component to said base inflatable component.

34. The inflatable device as defined in claim 1, wherein at least a portion of said component connector is positioned in an interior of said inflatable component when said inflatable component is at least partially connected to said base inflatable component by said component connector, said removable inflatable component includes an access opening to at least partially provide access to at least a portion of said component connector that is portioned in said interior of said inflatable component when said removable inflatable component is connected to said base of said component connector.

35. The inflatable device as defined in claim 2, wherein at least a portion of said component connector is positioned in an interior of said inflatable component when said inflatable component is at least partially connected to said base inflatable component by said component connector, said removable inflatable component includes an access opening to at least partially provide access to at least a portion of said component connector that is portioned in said interior of said inflatable component when said removable inflatable component is connected to said base of said component connector.

36. The inflatable device as defined in claim 31, wherein at least a portion of said component connector is positioned in an interior of said inflatable component when said inflatable component is at least partially connected to said base inflatable component by said component connector, said removable inflatable component includes an access opening to at least partially provide access to at least a portion of said component connector that is portioned in said interior of said inflatable component when said removable inflatable component is connected to said base of said component connector.

37. The inflatable device as defined in claim 32, wherein at least a portion of said component connector is positioned in an interior of said inflatable component when said inflatable component is at least partially connected to said base inflatable component by said component connector, said removable inflatable component includes an access opening to at least partially provide access to at least a portion of said component connector that is portioned in said interior of said inflatable component when said removable inflatable component is connected to said base of said component connector.

38. The inflatable device as defined in claim 33, wherein at least a portion of said component connector is positioned in an interior of said inflatable component when said inflatable component is at least partially connected to said base inflatable component by said component connector, said removable inflatable component includes an access opening to at least partially provide access to at least a portion of said component connector that is portioned in said interior of said inflatable component when said removable inflatable component is connected to said base of said component connector.

39. The inflatable device as defined in claim 34, wherein said access opening is closable.

40. The inflatable device as defined in claim 38, wherein said access opening is closable.

* * * * *